US009957963B2

(12) United States Patent
Stover et al.

(10) Patent No.: US 9,957,963 B2
(45) Date of Patent: May 1, 2018

(54) POWDER METAL SCROLLS WITH MODIFIED TIP DESIGNS

(71) Applicant: EMERSON CLIMATE TECHNOLOGIES, INC., Sidney, OH (US)

(72) Inventors: Robert C. Stover, Versailles, OH (US); Marc J. Scancarello, Troy, OH (US); Jean-Luc M. Caillat, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 692 days.

(21) Appl. No.: 14/498,316

(22) Filed: Sep. 26, 2014

(65) Prior Publication Data

US 2015/0093274 A1 Apr. 2, 2015

Related U.S. Application Data

(60) Provisional application No. 61/884,462, filed on Sep. 30, 2013.

(51) Int. Cl.
*F04C 18/02* (2006.01)
*B22F 7/06* (2006.01)
(Continued)

(52) U.S. Cl.
CPC ..... *F04C 18/0284* (2013.01); *B22F 5/10* (2013.01); *B22F 7/062* (2013.01);
(Continued)

(58) Field of Classification Search
None
See application file for complete search history.

(56) References Cited

U.S. PATENT DOCUMENTS 4,767,293 A 8/1988 Caillat et al.
4,846,639 A 7/1989 Morishita et al.
(Continued)

FOREIGN PATENT DOCUMENTS

CN 101275567 A 10/2008
CN 101617122 A 12/2009
(Continued)

OTHER PUBLICATIONS

International Search Report regarding Application No. PCT/US2014/058112, dated Jan. 9, 2015.
(Continued)

*Primary Examiner* — Mark Laurenzi
*Assistant Examiner* — Wesley Harris
(74) *Attorney, Agent, or Firm* — Harness, Dickey & Pierce, P.L.C.

(57) ABSTRACT

Scroll members for scroll compressors made from one or more near-net shaped powder metal processes, either wholly or partially fabricated together from sections. In certain variations, the involute scroll portion of the scroll member has a modified terminal end region. The terminal end region may include an as-sintered coupling feature comprising a tip component that forms a contact surface for contacting an opposing scroll member during compressor operation. The tip component can be a tip seal or a tip cap received by the as-sintered coupling feature. The tip cap may be sinter-bonded or otherwise coupled to the terminal end region. In other variations, a terminal end region may comprise a second material including a tribological material that forms a contact surface. Methods of making such scroll members for scroll compressors are also provided.

10 Claims, 5 Drawing Sheets

(51) Int. Cl.

| | |
|---|---|
| ***F04C 29/00*** | (2006.01) |
| ***F04C 23/00*** | (2006.01) |
| ***B22F 5/10*** | (2006.01) |
| ***C22C 33/02*** | (2006.01) |
| ***F04C 27/00*** | (2006.01) |

(52) U.S. Cl.

CPC ..... *C22C 33/0264* (2013.01); *F04C 18/0215* (2013.01); *F04C 18/0253* (2013.01); *F04C 23/008* (2013.01); *F04C 27/005* (2013.01); *F04C 29/0057* (2013.01); *B22F 2998/10* (2013.01); *F04C 2230/22* (2013.01)

(56) References Cited

U.S. PATENT DOCUMENTS

| | | | | |
|---|---|---|---|---|
| 5,035,589 | A | 7/1991 | Fraser, Jr. et al. | |
| 5,037,281 | A | 8/1991 | Lane et al. | |
| 5,088,906 | A | 2/1992 | Richardson, Jr. | |
| 6,079,962 | A * | 6/2000 | Seibel | F01C 1/0207 418/152 |
| 6,126,421 | A | 10/2000 | Matsumoto et al. | |
| 6,129,530 | A * | 10/2000 | Shaffer | F01C 17/06 29/888.022 |
| 6,705,848 | B2 | 3/2004 | Scancarello | |
| 7,070,401 | B2 | 7/2006 | Clendenin et al. | |
| 8,262,377 | B2 | 9/2012 | Caillat et al. | |
| 2003/0138339 | A1 * | 7/2003 | Scancarello | B22F 3/225 418/55.2 |
| 2008/0159893 | A1 | 7/2008 | Caillat | |
| 2008/0247895 | A1 * | 10/2008 | Caillat | F04C 18/0284 418/55.2 |
| 2010/0229386 | A1 * | 9/2010 | Scancarello | B22F 7/064 29/888.022 |
| 2012/0134862 | A1 * | 5/2012 | Hockliffe | F04C 27/005 418/55.1 |

FOREIGN PATENT DOCUMENTS

| | | | |
|---|---|---|---|
| EP | 0438025 | A2 | 7/1991 |
| EP | 2282060 | A2 | 2/2011 |
| FR | 2988127 | A1 | 9/2013 |
| JP | S62113882 | A | 5/1987 |
| JP | 2004003410 | A | 1/2004 |

OTHER PUBLICATIONS

Written Opinion of the International Searching Authority regarding Application No. PCT/US2014/058112, dated Jan. 9, 2015.

Office Action regarding Chinese Patent Application No. 201480053759.4, dated Nov. 4, 2016. Translation provided by Unitalen Attorneys at Law.

Search Report regarding European Patent Application No. 14848915.6, dated Apr. 21, 2017.

Office Action regarding Chinese Patent Application No. 201480053759.4, dated Jun. 16, 2017. Translation provided by Unitalen Attorneys at Law.

* cited by examiner

POWDER METAL SCROLLS WITH MODIFIED TIP DESIGNS

CROSS-REFERENCE TO RELATED APPLICATIONS

This application claims the benefit of U.S. Provisional Application No. 61/884,462, filed on Sep. 30, 2013. The entire disclosure of the above application is incorporated herein by reference.

FIELD

The present disclosure relates generally to compressors and refers more particularly to scroll components of a compressor having integrally formed tip sealing and methods for making such compressors.

BACKGROUND

A scroll compressor has several factors that influence its performance. One of those factors is the amount of leakage that occurs in the compression mechanisms (or scrolls) during operation. A scroll compressor typically has two scroll members each defining involute scroll portions, which are intermeshed together to define sealed pockets. The scroll itself follows a path of motion that allows the involute portion of the scrolls to capture and transfer the sealed pockets from the outer region of the involute scroll portion (or the inlet) to the central region of the involute scroll portion (or outlet). These fluid pockets are reduced in size and compressed as they are transferred from inlet to outlet. Once the pocket reaches the central portion of the involute (the outlet), the fluid pocket will be at its smallest volume and highest pressure and thus can be discharged to a delivery system.

However, the pressure of the compressed refrigerant in the compression pockets, together with manufacturing tolerances of the component parts, may cause slight radial separation of the scroll members and result in the aforementioned leakage. Efforts to counteract the separating forces applied to the scroll members during compressor operation, and thereby minimize such potential leakages, have resulted in the development of several different types of compressor designs to enhance compliance. Scroll members in the scroll compressor may be preloaded axially toward each other or otherwise exposed to a force sufficient to resist a dynamic separation force to facilitate axial compliance and minimize separation. For example, certain compressors can have pressurized "high sides," so that discharge pressure is used on a back side of one or both scroll members to create a force to oppose the separating forces. In other conventional compressor designs, the respective fixed and orbiting scroll members are both axially movable or "floating" and are biased toward one another by a biasing means, such as exposing one or both back surfaces of the scroll components to a combination of discharge pressure and suction pressure.

However, even with such conventional biasing mechanisms, leakage in the compression pockets can still potentially occur. Such leakage undesirably results in increased work required from the compressor. Therefore, performance of the compressor can be improved by minimizing or eliminating such potential leakage by improving pocket sealing between the two intermeshing involutes and/or at other sealing interfaces in the scroll compressor.

The statements in this section merely provide background information related to the present disclosure and may not constitute prior art. Further areas of applicability will become apparent from the description provided herein. It should be understood that the description and specific examples, while indicating the preferred embodiment of the teaching, are intended for purposes of illustration only and are not intended to limit the scope of the present disclosure.

SUMMARY

This section provides a general summary of the disclosure, and is not a comprehensive disclosure of its full scope or all of its features.

In various aspects, the present disclosure provides improved scroll members for a scroll compressor and methods for making such improved scroll members. In certain aspects, the present disclosure provides a scroll member that comprises an involute scroll portion and a baseplate portion. The scroll member comprises a sintered powder metal material. The involute scroll portion defines a terminal end region comprising an as-sintered coupling feature. The terminal end region of the involute scroll portion comprises a tip component that forms a contact surface for contacting an opposing scroll member during compressor operation. The tip component may comprise a tip seal component or a tip cap component (or both a tip cap component and a tip seal component) that forms the contact surface for contacting an opposing scroll member during compressor operation. Such a modified terminal end region of the involute scroll portion can withstand wear during harsh compressor operating conditions, while providing superior axial sealing.

In other variations, a scroll member is provided that comprises an involute scroll portion and a baseplate portion. The scroll member comprises a first sintered powder metal material. Further, the involute scroll portion defines a modified terminal end region that comprises a second material comprising at least one tribological material. The second material forms a contact surface capable of contacting an opposing surface of an opposing scroll member and withstanding wear during compressor operation. Again, such a modified terminal end region of the involute scroll portion can withstand wear during harsh compressor operating conditions, while providing superior axial sealing with low abrasion and friction losses.

In yet other variations, a method for forming a scroll member comprises introducing a metallic powder metal material comprising an iron alloy into a mold defining a cavity having a shape defining an involute scroll portion of the scroll member. The method further comprises compressing the mixture into the mold to form a green involute scroll member that includes an involute scroll portion that defines a terminal end having a coupling surface feature. In certain aspects, the coupling feature is capable of receiving a tip component that forms a contact surface for contacting an opposing scroll member during compressor operation. The tip component may be a tip seal component or a tip cap component in certain variations. Then, the green involute scroll member is removed from the mold. The green involute scroll member is then sintered to form an involute scroll portion comprising the as-sintered coupling feature.

In yet other aspects, the present disclosure provides other methods of making a scroll member, which comprises forming the scroll member defining an involute scroll portion and a baseplate portion by sintering a first powder metal material in a mold defining a cavity having a shape defining the involute scroll portion and the baseplate portion. The scroll member comprises a first sintered powder metal material. The involute scroll portion of the scroll member defines a terminal end region that further comprises a second material comprising a tribological material that forms a contact surface for contacting an opposing scroll member during compressor operation.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

Figure 1:
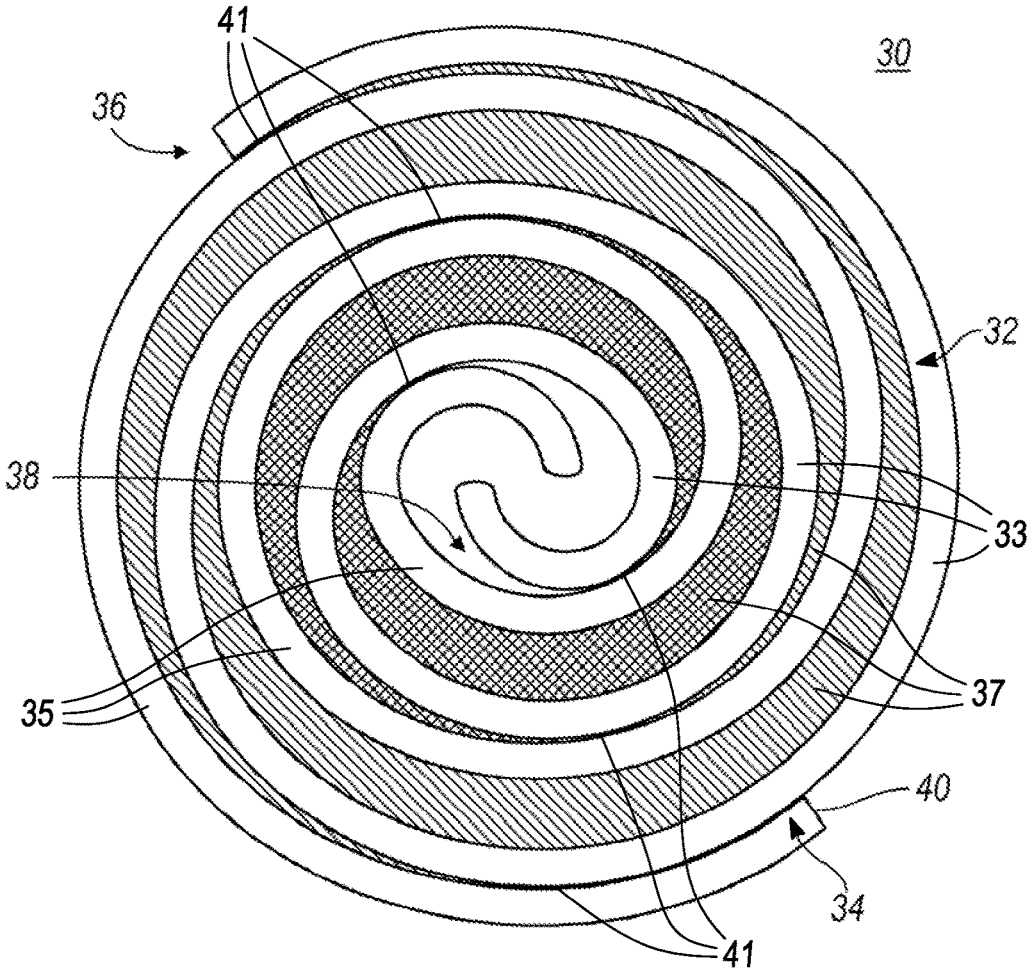
FIG. 1 represents sealing relationships of fluid pockets formed between a pair of involute scroll members.
Figure 4:
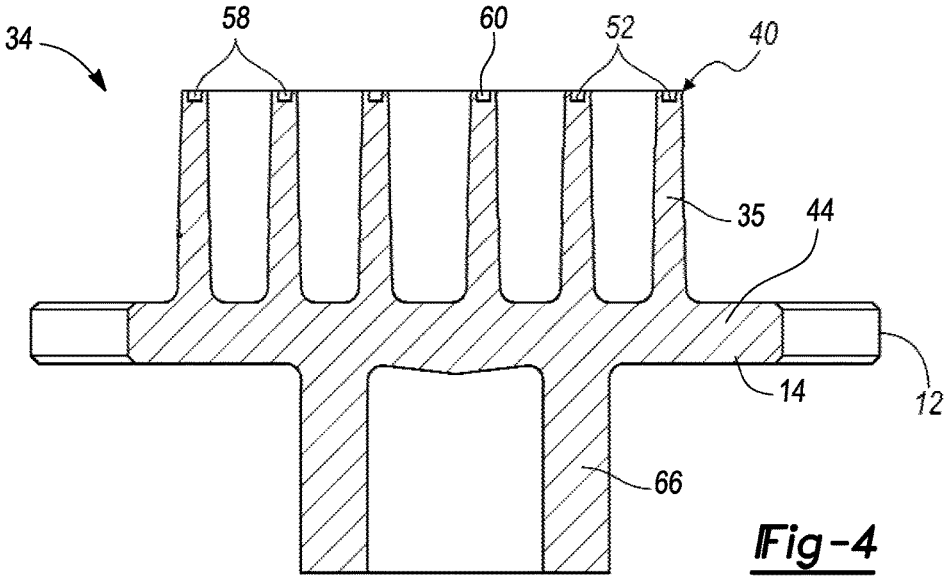
FIG. 4 represents a cross-sectional view of the scroll component shown in FIGS. 2 and 3.
Figure 5A:
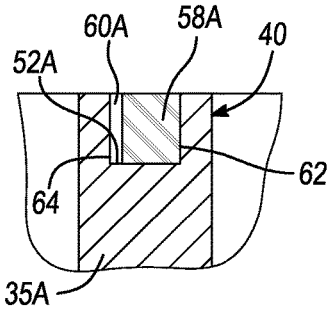
Figure 5B:
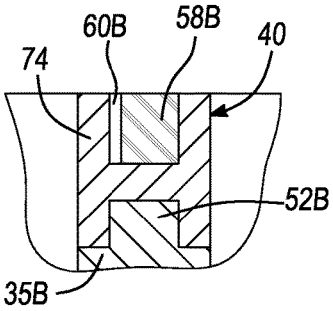
Figure 5C:
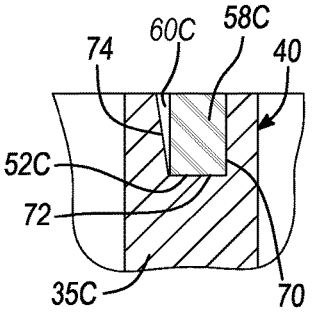
Figure 5D:
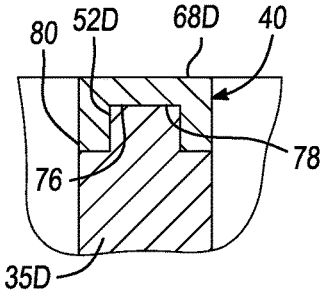
Figure 5E:
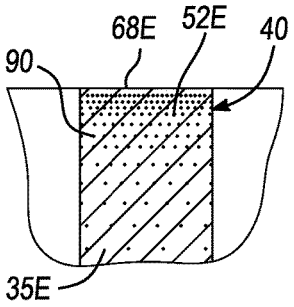
Figure 5F:
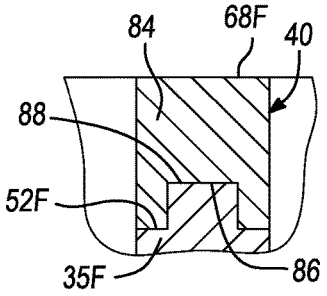
Figure 6:
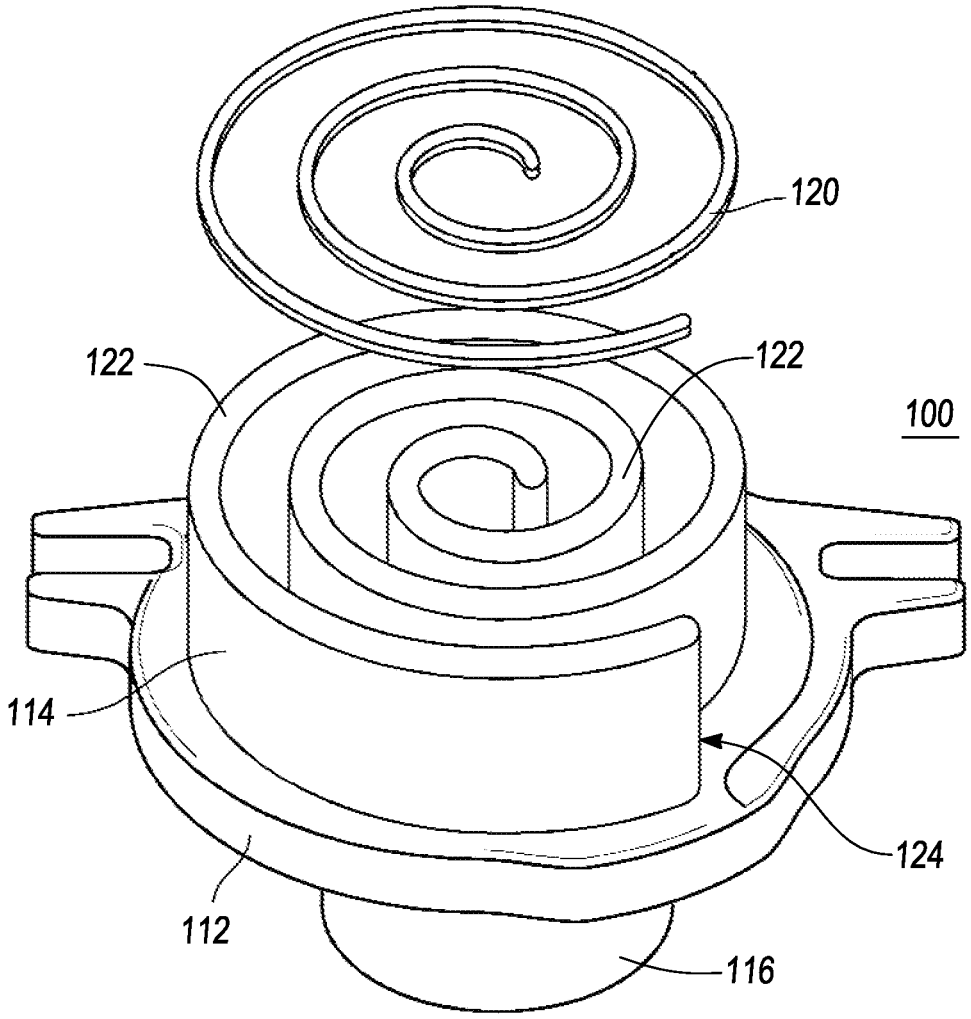
Figure 7:
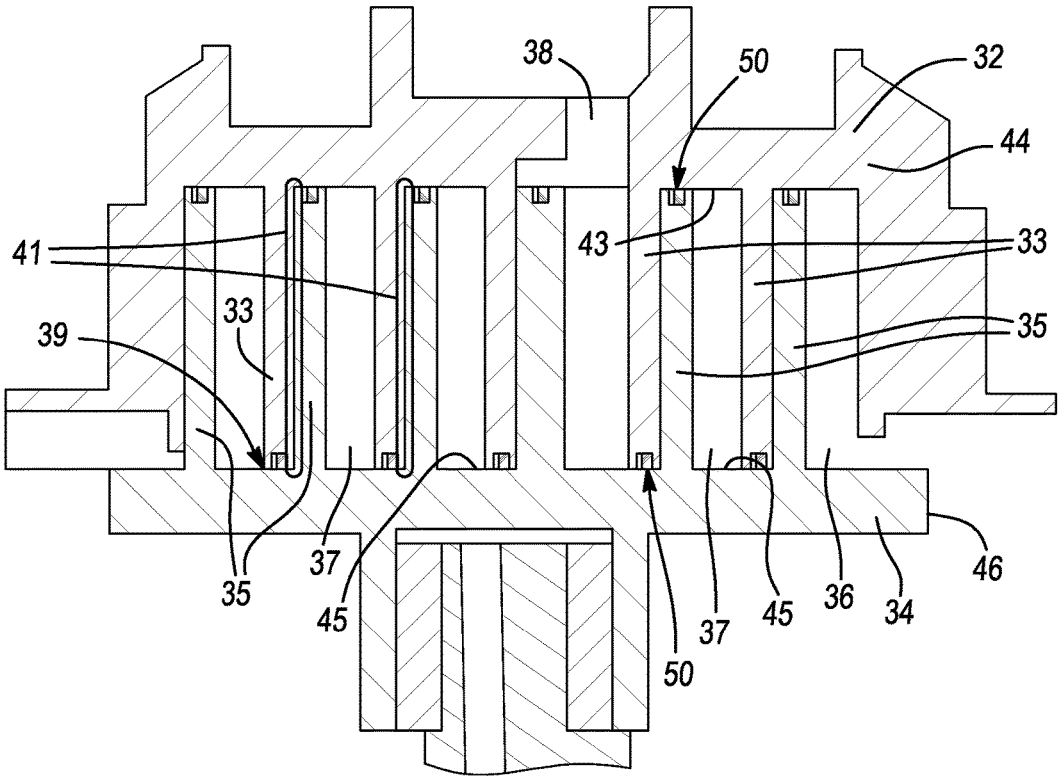

FIGS. 5A-5F show various tip component modifications for scroll compressor components prepared in accordance with certain principles of the present teachings. The embodiments of FIGS. 5A-5C represent optional tip component designs comprising tip seals for the involute scroll portion of the scroll component shown in FIG. 4, while FIGS. 5D-5F represent alternate embodiments of terminal tip components comprising tip caps on an involute scroll portion of a scroll component prepared in accordance with certain principles of the present teachings;

FIG. 6 represents a perspective view of the formation of an alternate scroll component according to the teachings of the present disclosure; and FIG. 7 represents a cross-sectional view of an assembly of stationary and orbiting scroll members in a scroll compressor like the pair of involute scroll members shown in FIG. 1.

DETAILED DESCRIPTION

The following description is merely exemplary in nature and is not intended to limit the present disclosure, application, or uses. It should be understood that throughout the drawings, corresponding reference numerals indicate like or corresponding parts and features.

"A," "an," "the," "at least one," and "one or more" are used interchangeably to indicate that at least one of the item is present; a plurality of such items may be present. The terms "comprises," "comprising," "including," and "having," are inclusive and therefore specify the presence of stated features, integers, steps, operations, elements, and/or components, but do not preclude the presence or addition of one or more other features, steps, elements, components, and/or groups thereof. It is also to be understood that additional or alternative method steps may be employed. Throughout this disclosure, the numerical values represent approximate measures or limits to ranges to encompass minor deviations from the given values and embodiments having about the value mentioned as well as those having exactly the value mentioned. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range, including endpoints given for the ranges.

Figure 2:
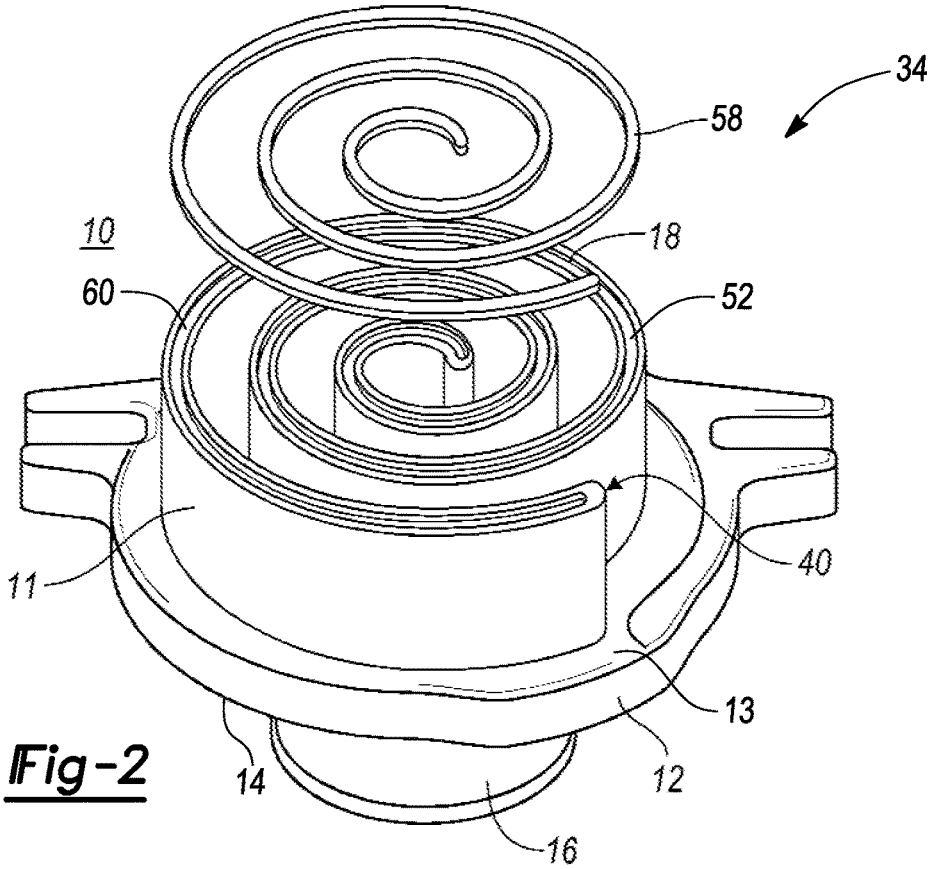
FIG. 2 represents a perspective view of a scroll member according to the teachings of the present disclosure.
Figure 3:
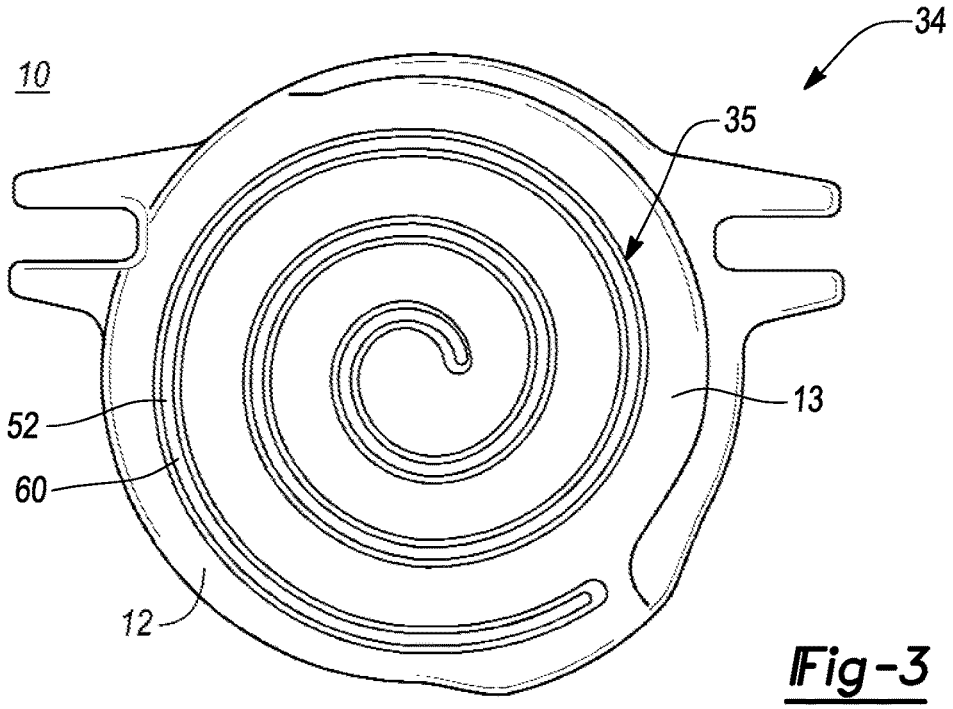
FIG. 3 represents a top view of the scroll component shown in FIG. 2.

FIGS. 2 through 4 represent a scroll member according to certain aspects of the teachings of the disclosure. An involute scroll member 10 includes an involute scroll portion 11 and a platen or baseplate portion 12. The involute scroll portion 11 is disposed along a first side 13 of the baseplate portion 12. In certain embodiments, for example, where the involute scroll member 10 is an orbiting scroll, a second opposite side 14 of baseplate portion 12 either defines or is coupled to a hub 16 that receives a drive shaft (not shown) to translate motion to the involute scroll member 10.

FIG. 1 shows an overhead sectional view of the two intermeshed involute scroll members of an exemplary scroll compressor 30. FIG. 7 shows a sectional view of the same intermeshed involute scroll components. The compressor 30 has a first non-orbiting involute scroll member 32 that defines a first involute scroll portion 33 and a second orbiting involute scroll member 34 that defines a second involute scroll portion 35. The first involute scroll member 32 is stationary, while the second orbiting involute scroll member 34 orbits in relation to the first involute scroll member 32. The first and second involute scroll portions 33, 35 are intermeshed together to define sealed fluid pockets 37. The second orbiting involute scroll member 34 follows a path of motion that allows the first and second involute scroll portions 33 and 35 to capture and transfer the sealed pockets 37 from an outer portion (or an inlet 36) to a central region corresponding to an outlet or discharge port 38 of the first involute scroll portion 33 of the non-orbiting scroll member 32.

Each of the first and second involute scroll portions 33, 35 is a spiral or involute vane having a terminal region formed on the non-orbiting and orbiting involute scroll members 32, 34. For example, in FIG. 7, the first involute scroll portion 33 of non-orbiting scroll member 32 defines a first terminal region 39. A terminal end region 40 of second involute scroll portion 35 of second orbiting involute scroll member 34 can be seen in FIG. 7, as well as in FIGS. 2 and 4. In various aspects, the material forming the scroll components should be able to withstand sliding motion under contact pressure and be strong enough to handle the mechanical loads at extreme operating conditions for a scroll compressor. Machinability of the material can also affect surface characteristics, which can potentially affect sealing. For example, many scrolls are presently formed of gray cast iron. Gray cast iron has certain characteristics that allow it to be machined and operate at the typical aforementioned extreme operating conditions; however, many materials are not suitable for these purposes. In accordance with the present disclosure, portions of the scroll member, including the involute scroll portion are manufactured from metallic powder materials.

As used herein, the term "metallic powder" material refers to a material that is formed from a plurality of metal particles, such as metal powder, which will be described in more detail below. Metallic powder materials include both the intermediate processing forms (for example, "green" forms, meaning after compression/pressing, but before sintering and those forms which still contain binder) and final products, such as sintered powder metal materials. Such a metallic powder material is optionally formed by conventional powder metallurgy processing, such as conventional compression powder metal processing or metal injection mold processing, as will be described in greater detail below. In various aspects, the disclosure provides scroll members formed from sintered metallic powder, which enables desirable material characteristics and certain advantages for the terminal end regions of the involute scroll portions formed from sintered powder metal materials and optionally into the opposing scroll base areas.

In FIG. 4, the relationship is shown between the involute scroll portion 35 of second orbiting involute scroll member 34, baseplate portion 44, and drive hub 66. Hub 66 and involute scroll portion 35 are optionally integrally formed with the baseplate portion 44, for example, from a sintered powder metal material. In alternative embodiments, the hub 66 and/or involute scroll portion 35 can be formed separately from the baseplate portion 44 and later attached and coupled thereto.

As appreciated by those of skill in the art, maintaining the fluid pocket 37 by sealing between the two intermeshed involute scroll portions (e.g., 33, 35) is important for compressor operation and efficiency. Thus, maintaining sealing and minimizing potential leakage along the involute scroll portions of the scroll members improves compressor operation. In certain aspects of the present teachings, such powder metal materials allow tailoring of the tribological characteristics of one or more sealing surfaces in the scroll member to further improve sealing and hence, compressor operation. For example, one seal is a radial seal that occurs at a contact line (extending out of a plane defined by the page in FIG. 1 or in FIG. 7) between the faces of the first and second involute scroll portions 33, 35, where they contact and touch one another (at 41) in FIGS. 1 and 7. Other seals 50 occur at the planar surfaces of the tips of the involute scroll portion vanes corresponding to these terminal end regions (e.g., 39, 40 of FIG. 7) as they interface with a contact surface of a baseplate portion of the opposing scroll (an axial seal). For example, a first contact surface 43 is defined by a baseplate portion 44 of the non-orbiting scroll member 32 and a second contact surface 45 is defined by a baseplate portion 46 of the second orbiting involute scroll member 34.

The effectiveness of sealing of the pockets is related to the clearance at the involute contact surfaces (for example, at axial seals 50 where first terminal region 39 interfaces with second contact surface 45 or where second terminal region 40 interfaces with first contact surface 43), thus, during compressor manufacture it is preferable to maintain the clearance to be as small as possible. The axial seals 50 formed between the planar surfaces of the involute tips or terminal end regions 39, 40 and a surface of an opposing scroll member's baseplate portion (e.g., first or second contact surfaces 43, 45) are larger in length than a seal formed by the contact regions of faces 41 of the involute scroll portions 33, 35. Thus, the axial seal(s) 50 formed between the involute scroll portion tips/terminal regions 39, 40 and opposing contact surfaces of the baseplate portions (43, 45) tends to be the sealing region that has the greatest impact on fluid leakage. In certain aspects, the present disclosure is directed to improving the axial seal that is formed between a terminal end region or tip of an involute scroll portion and a contact surface of the opposing baseplate portion of the opposing scroll member when assembled in a meshing operational configuration of a scroll compressor like that shown in FIG. 7. As described below, in accordance with certain aspects of the present disclosure, terminal end regions 40 along vanes or involute scroll portion 35 can be modified to incorporate or be capable of receiving a tip component, such as a tip seal, a tip cap, and/or otherwise modified to enhance tribological properties of the materials and improve compressor performance.

Various sealing techniques and designs can be used to control the clearances at the planar sealing surfaces in a scroll compressor. One exemplary scroll compressor design permits a scroll member's terminal ends of the involute scroll portion to contact an opposing surface of the scroll member baseplate portion (when assembled in intermeshing relationship to one another) during operation such as described in U.S. Pat. No. 4,767,293, which is herein incorporated by reference in its entirety. In uniform thermal equilibrium of the parts, any potential clearance gap can be attributed to dimensional mismatch and can be corrected for/controlled through precision machining of the involute scroll portions. In other exemplary designs, a scroll member's terminal end tips of the involute scroll portion may not contact the opposing surface of the scroll member baseplate portion during operation. In certain designs, an axially translatable scroll member's terminal ends of the involute scroll portions do not contact the opposing surface of the scroll member baseplate portion during compressor operation, but rather employ a floating tip seal. "Tip seals" are sealing elements that are positioned at a terminal end region/tip of an involute scroll portion of a scroll member that are capable of forming a seal with a contact surface of an opposing baseplate portion of an opposing scroll member. In certain variations, a tip seal floats in a groove of the terminal end of the involute scroll portion and enables axial sealing by being pressure loaded against the opposing baseplate portion surface and resulting in a continuous axial seal that responds to changing pressure and temperature conditions.

By way of background, one method of improving sealing pertains to the improvement of tip seals to enhance sealing for certain scroll compressor designs, such as those where a terminal end region of the involute scroll portion of one scroll member does not actually contact the baseplate surface of the opposing scroll member (e.g, in a floating axial seal design). Such seals have been used in the past to provide a desirable seal that meets the characteristics described above. However, in the past, potential disadvantages to using tip seals have been finding an appropriate and effective manner to couple them to a terminal end of the involute scroll member tips. This was typically achieved by the formation of a groove via machining in a coupling surface at a terminal end of an involute scroll portion tip. However, the creation of such a groove generally requires a significant amount of machining, which can be difficult and costly in view of the relatively complex form and high precision required for the entire length of the groove (along the entire involute vane tip). Moreover, machining such a groove generally requires a relatively small tool which, to control the precision of the groove and achieve a relatively good surface quality, requires the machining process to be time-consuming and costly. For this reason, in the past, design of scroll compressors employing tip seals have been predominately avoided.

In various aspects, the present disclosure provides a powder metal scroll that is formed by a fabrication method that provides the ability to accurately and effectively incorporate a robust coupling feature to position and/or couple a tip seal with the terminal end regions of an involute scroll portion of a scroll member with relative ease, without requiring lengthy and costly machining. Scroll members formed by conventional powder metal processing of sintered metallic powder materials provide such capabilities. Such robust coupling features at the terminal end of the involute scroll portion formed from a sintered powder metal can include an as-sintered net-shaped groove or channel, for example, formed in a sintered scroll member, which is capable of receiving a tip seal without requiring any further machining.

Thus, in certain aspects, the teachings of the present disclosure are directed towards forming a scroll member for a scroll compressor, where at least one of the scroll compressor members is produced utilizing powder metallurgy techniques. In certain variations, a scroll member, including the baseplate portion and the involute scroll portion, is formed from a sintered powder metal. In yet other variations, a scroll member, including the baseplate portion, the involute scroll portion, and the hub portion, are all formed from a sintered powder metal. Such portions of the scroll member may be formed as a monolithic sintered powder metal piece where each portion is integrally formed with one another in a single mold, or alternatively may be formed separately and then later joined by sinter-brazing, by way of non-limiting example. Further, in certain aspects, select components or members of the scroll member can be optionally formed of metallurgy techniques other than powder metallurgy, and then later coupled with or fastened to the components formed of metallic powder materials. For example, "conventional" metallurgy formation techniques include casting or forging. Additionally, in some aspects, a scroll member for a scroll compressor formed of a sintered metallic powder can be coupled to another independently formed member formed of a metallic powder material. Moreover, in accordance with various aspects of the present disclosure, a scroll member comprises an involute scroll portion having a terminal region that includes a modified tip design, for example, capable of incorporating a tip component, such as a tip seal or a tip cap, which is integrally formed with or coupled to the involute scroll portion either before or after a sintering process of the metallic powder material.

As discussed above, the involute scroll portion (either 33 or 35) defines a terminal end region (e.g., 39 or 40). As shown in FIGS. 2 and 4, terminal end regions or tips 40 generally define a coupling surface 52. In certain aspects, at least one coupling feature is defined in or formed as part of the coupling surface 52. In certain aspects, such a coupling feature positions a tip component, like a tip seal, for later retention or coupling. It should be noted that in certain aspects, a "coupling feature" as used herein encompasses a feature that merely positions another component, but does not necessarily couple, fix, fasten, or otherwise attach the other component thereto.

Examples of certain embodiments of terminal end regions (e.g., 39 or 40) of involute scroll portions 33, 35 having coupling features for tip components comprising tip seals in accordance with certain aspects of the present disclosure are shown in FIGS. 5A-5C. FIG. 4 depicts a tip component comprising a tip seal 58 that is disposed in a groove 60 of the coupling surface 52 of the terminal end region 40 of the involute scroll portion 35. It should be noted that any discussion of the design principles of the modified terminal end region 40 of involute scroll portion 35 of the second orbiting involute scroll member 34 discussed herein are not limited to the orbiting scroll and are equally applicable to the opposing non-orbiting scroll member 32 and its terminal region 39 of involute scroll portion 35 as well. In certain aspects, the tip seal 58 may be placed or seated in the groove 60 after the formation of the involute scroll portion 35 (e.g., after formation by sintering) during the compressor assembly, so that it floats in the groove 60. In other variations, the tip seal 58 may be fastened or coupled to one or more portions of the groove 60 defined in the coupling surface 52, either before or after the formation process, e.g., sintering process. Such a coupling process may include attaching the tip seal 58 via fasteners, adhering, brazing, welding, or the like to the coupling surface 52.

FIGS. 5A through 5C represent certain sealing configurations for a scroll member of a scroll compressor prepared in accordance with certain aspects of the present teachings, which include a tip component comprising a tip seal that cooperates with coupling surface 52 on the terminal end region 40 of the scroll member shown in FIG. 4, for example. In certain aspects, the terminal end regions 40 of the involute scroll portion 35 optionally contain at least one coupling feature or coupling mechanism, which can take the form of a groove or a coupling flange. More specifically, tip seals 58A, 58B, or 58C are incorporated after sintering of the involute scroll portions (35A-35C) by being seated adjacent to coupling surfaces 52A, 52B, or 52C of the terminal end region 40.

As seen in FIGS. 5A and 5C, the coupling feature is in the form of grooves 60A, 60B, and 60C. Such grooves can have an interior surface with walls which are straight (substantially orthogonal) or tapered. In FIG. 5A, a coupling feature in the form of a groove 60A is shown formed in coupling surface 52A of involute scroll portion 35A that is capable of receiving a tip component in the form of tip seal 58A within groove 60A. It should be noted that groove 60A also encompasses a channel or a recess in certain variations. Thus, groove 60A can be created by a powder metal mold to define a recess or groove along the terminal end region 40 of the involute scroll portion 35A, so that when the involute scroll portion 35A is formed by powder metallurgy techniques, groove 60A has a near-net shape molded into the terminal region(s) of the sintered powder metal involute scroll portion. Notably, in certain variations, a tip seal 58A may be positioned or seated in groove 60A so that tip seal 58A is adjacent to or in contact with a radially outward side or edge 62 of groove 60A, while a slight gap remains along a radially inward edge 64 of groove 60A. For example, the tip seal 58A may float in the groove 60A.

Thus, in FIG. 5A, a coupling feature is formed in coupling surface 52A of involute scroll portion 35A that defines groove 60A that is capable of accepting a tip component in the form of a tip seal 58A. In certain preferred aspects, the coupling feature in the form of a groove 60A is pre-formed by being molded during sintering of the powder metal material and does not require any further machining after sintering the scroll member. The tip seal 58A is thus positioned or seated within groove 60A. In embodiments where the tip seal 58A floats within the groove 60A without being further fastened thereto, it is positionally retained in the groove 60A when placed adjacent to the opposing contact surface of the baseplate portion of the opposing scroll member (e.g., first contact surface 43 of baseplate portion 44 of first involute scroll member 32). The cross-sectional shape of the groove 60A in FIG. 5A is shown to be rectangular, although in alternate embodiments other shapes, including curved groove surfaces are contemplated. In certain alternative aspects, the tip seal 58A may be further fastened or attached to groove 60A.

Likewise, in the embodiment of FIG. 5C, a coupling surface 52C of involute scroll portion vane 35C defines a coupling feature as a groove 60C (which is similarly preformed by being molded during sintering of the powder metal) that is capable of accepting a tip component comprising tip seal 58C. The shape of the groove 60C is tapered (e.g., polygonal) having a radially outward side or edge 70 that is substantially at a right angle to a bottom side 72, while a radially inward side or edge 74 forms an offset angle with respect to the bottom side 72 (here shown to be an obtuse angle offset from bottom side 72 by approximately 100°).

As noted above, the coupling feature is in the form of grooves 60A and 60C in FIGS. 5A and 5C. The present teachings contemplate grooves that have one or more interior surface walls which are straight (orthogonal) or optionally tapered when viewed cross-sectionally across the involute vane portion terminal end region. In this regard, either one or both walls of the groove are optionally tapered. Tapering can facilitate and assist with green part ejection from a mold while reducing internal rejects of the green part during manufacturing. Tapering also increases the life of the powder metal forming tool, which can be an important economic factor. Tapering of the groove has the potential to reduce sealing capability at the terminal end region of the involute scroll portion; however, depending on the form of the tip seal or how the tip seal interacts with the groove. For an embodiment where a single side of the groove is tapered (like in FIG. 5C), if the tip seal is of rectangular cross-sectional shape, then the tapered side can be formed on a side of the groove opposite that which the tip seal contacts during compressor operation (e.g., the tapered wall is formed on a radially inward side of the scroll compressor closer to the central region).

FIG. 5B shows yet another embodiment, where a terminal end region 40 of involute scroll portion 35B includes a plurality of coupling features, including a distinct tip cap component in the form of a coupling flange 75. The coupling flange 75 defines a secondary coupling feature in the form of groove 60B that is capable of receiving a tip component comprising a tip seal 58B, which is shown seated therein.

As described earlier, in certain scroll compressor design configurations, a sealing method may permit a terminal end region of an involute scroll portion of a scroll member to contact an opposing surface of a baseplate portion of an opposing scroll member for axial sealing. In such a design, the properties of such a terminal end portion (e.g., a tip surface) may be required to be different from that of the rest of the involute scroll portion/scroll member itself, especially the baseplate portion of the opposing scroll member with which the involute scroll portion is in contact. Where a terminal end region of an involute scroll portion of a scroll member experiences contact and wear against an opposing baseplate, in accordance with the certain aspects of the present disclosure, a modified tip design may include the terminal end region of the involute scroll portion being formed of distinct material from the remaining portion of the involute scroll portion. Such a distinct material is considered to be a tip component comprising a "tip cap." In certain variations, a tip cap is a distinct component formed of a different material than the sintered powder metal involute scroll portion. The tip cap may be coupled to a coupling surface 52 of a terminal end region of an involute scroll portion. Such a tip cap provides a sealing surface for an axial seal that advantageously prevents excessive abrasive wear, as well as adhesive (scuffing) wear during compressor operation.

As shown in FIGS. 5D through 5F, a terminal tip component comprises a tip sealing contact surface (68D in FIG. 5D, 68E in FIG. 5E, and 68F in FIG. 5F) for axial sealing engagement with a surface of an opposing baseplate portion is optionally formed by using powder metal techniques to be either integral with an involute scroll portion 35 (68E in FIG. 5E) or alternately formed as a separate component (e.g., a tip cap of 68D in FIG. 5D and 68F in FIG. 5F). In this regard, the terminal tip sealing surface can be coupled to the green powder involute scroll portion 35 after the forming of the pressed green powder involute scroll portion 35.

In variations like those shown in FIGS. 5D and 5F, a coupling surface has a coupling feature on the coupling surface that is in a form of a protruding ridge or flange, which allows a distinct component to be similarly positioned over terminal end regions of vanes of the involute scroll portion to provide a modified tip surface. In such embodiments, a coupling feature in the form of a flange can avoid potential issues with fragile groove side walls, because the flange is a central protrusion that can be formed in the powder metal part (as-sintered, without requiring any machining) over which a distinct component can be placed, for example, prior to sintering the involute scroll portion. In certain variations, a central protrusion coupling feature can be a continuous ridge (similar to the continuous groove or channel) formed along the entire coupling surface of the involute scroll portion.

In FIG. 5D, the terminal end region 40 of involute scroll portion 35D defines a coupling surface 52D having a coupling feature in the form of a protruding ridge or flange 76. The protruding flange 76 is capable of coupling with a tip component comprising a tip cap 80 that has a complementary coupling feature 78 (e.g., a centrally disposed mating groove) recessed therein. In certain variations, tip cap 80 is formed of a distinct material from involute scroll portion 35D, where such a tip cap material preferably has comparatively improved lubricity or wear characteristics for forming a wear surface and seal.

In FIG. 5F, a terminal end region 40 defines a coupling surface 52F of involute scroll portion 35F that has a coupling feature in the form of a protruding ridge or flange 86. The protruding flange 86 is capable of coupling with a distinct tip component comprising a tip cap 84 having a complementary coupling feature (e.g., a centrally disposed mating groove 88) recessed therein. Such a protruding flange 86 can extend continuously along the terminal end region surface of the involute scroll portions from an initial side to a terminal side of the involute scroll portion. Tip cap 84 is thus capable of providing tip sealing at the terminal end region 40 along the entirety of the involute scroll portion. Notably, tip cap 84 has a greater height than comparative tip cap 80 and thus forms a greater portion of the structure of the involute scroll portion 35F in FIG. 5F as compared to involute scroll portion 35D in FIG. 5D.

In certain aspects, wear properties between terminal end regions 40 of involute scroll portion 35 and an interface or counter contact surface (e.g., first contact surface 43 of the opposing baseplate portion 44 in FIG. 7) can be designed by either incorporating in-situ solid phase lubrication into the contact surface regions of the metals during powder metal formation or by creating sufficiently chemically dissimilar materials at the interface to prevent adhesive interaction. Thus, a tip component comprising a tip cap may include a terminal end region of an involute scroll portion that is integrally formed with the involute scroll portion, but has a differing material composition than the remainder of the involute scroll portion.

This may be achieved by incorporating one or more materials, such as tribological materials, into a terminal end region of the involute scroll portion during the formation process so that the terminal end region has a differing composition than the bulk of the sintered powder metal involute scroll portion of the scroll member. In certain variations, incorporation of free graphite into a material (e.g., a powder metal material) disposed in a terminal end region of an involute scroll portion defines a tip component that forms a wear or contact surface, such as a tip seal or a tip cap, which can facilitate reduced wear, particularly where the opposing surface does not also contain free graphite.

FIG. 5E shows yet another variation of the present disclosure, where involute scroll portion 35E has a coupling surface 52E that has a different composition than a bulk material composition forming the remainder of the involute scroll portion 35E. By a "different composition," it is meant that the relative proportion of compounds or material may vary, or that additional or distinct compounds or materials may be present in the region forming the coupling surface 52E. For example, the terminal end region 40 of the involute scroll portion may comprise a similar metallic powder composition as that used in the bulk of the involute scroll portion, but may further include one or more distinct materials, like a tribological material for enhancing wear resistance or improving tribological properties.

In FIG. 5E, when the involute scroll portion is being formed, a tribological material can be introduced into a terminal end region 40 to define a tip component that forms a contact surface for contacting an opposing scroll member during compressor operation. The tribological material can form a concentration gradient (where it is primarily concentrated near the coupling surface 52E for tip sealing and then transitions to lower concentrations into the bulk of the involute scroll portion powder metal). A concentration gradient of a tribological material phase 90 is formed from a terminal surface 68E of the modified terminal end region 40 in a direction towards the baseplate region to define a tip component comprising a tip cap that has a robust bond between the first material and the second material in the involute scroll portion 35E. Thus, in certain aspects, such a distinct composition on the coupling surface 52E may be introduced during the powder metal fabrication process (for example, disposed in a mold cavity), followed by sintering and processing of the involute scroll portion 35E.

In certain variations, a tip component in the form of a tip seal 58 is optionally pre-formed and subsequently physically coupled to a coupling surface 52 of terminal end regions 40 of the involute scroll portion 35 of second orbiting involute scroll member 34. As discussed above, any contacting seal surface is preferably formed of materials that are dissimilar to a facing counter surface to reduce wear during contact. For example, the tip seal material can be selected to be distinct from cast iron or steel when the opposing base plate contact surface is formed of these materials. In various aspects, non-limiting suitable seal materials, including those for tip seals, include a ceramic matrix composite, metal matrix composite, polymer matrix composite, pure monolithic materials, or other materials that are well known to those of skill in the art.

In certain aspects, one or both of the involute scroll portions may incorporate tip components comprising tip seals or tip caps. Such a tip cap may be a separate component or may involve introduction of extra tribological material phases mixed with the alloy(s) used to form the sintered metallic powder material, as described below. Such tip seals, tip caps, and tribological material phases are optionally included to provide a safeguard for potentially harsh (marginal lubrication) compressor conditions. In various aspects, the scroll members according to the present teachings optionally have a modified terminal end region defining a tip component, whether in the form of a tip seal or a tip cap, configured to be chemically dissimilar to the surface chemistry of the contact surface of the opposing baseplate portion, with which the terminal end region interacts to reduce wear.

In certain aspects, a coupling feature, whether in the form of a groove or a flange, can be formed by creating a powder metal mold that defines the coupling feature in the involute scroll portion itself. In other aspects, a coupling feature, whether in the form of a groove or a flange, can be formed in a green metallic powder material involute scroll portion of a green metallic powder scroll member (after formation in a mold). In addition, a coupling feature may be further machined from a green metallic powder scroll member prior to sintering. Such processing can avoid expensive post-sintering machining of the involute scroll portion, as pre-sintered powder metal is substantially easier to machine. Thus, a coupling feature like those shown in any of FIGS. 5A-5D and 5F can be formed either during pressing or can be later machined into the involute scroll portion when the scroll member is in a green state by "green machining"—after pressing, but before sintering. While green parts can be fragile, such parts tend to be machinable due to at least partial bonding of the metal particles together via a binder system (although the bonding is relatively weak as compared to after sintering when metallurgical bonding occurs in the powdered metal).

In certain aspects, if the coupling feature on the coupling surface 52 of the involute scroll portion 35 is formed by machining a green powder metal part, the involute scroll portion 35 has a green density of greater than or equal to about 6.8, particularly at the terminal end region 40 near the coupling feature. In certain aspects, such a green density is greater than or equal to about 7. A relatively low density material may potentially be too fragile and could potentially cause metal particles to break-away during machining, if such machining is required. In some aspects, handling and/or machining of green parts is conducted in a manner that preserves the physical integrity of the part, including the side walls of the groove, which can be fragile due to the narrow dimensions. Green components tend to be substantially weaker than sintered final product scrolls, thus, it may be desirable to form the green scroll member using warm compaction or grain size optimization, particularly if the green part will be machined.

As discussed above, in certain variations, components or portions of components of the scroll compressor are formed by powder metallurgy. While a scroll member, including involute scroll portion, baseplate portion and/or hub can be integrally formed via powder metallurgy techniques, alternately one or more of these components can be separately formed by powder metal techniques and later joined together, for example, by sinter-brazing with a brazing material disposed within any joints. However, certain components, such as the involute scroll member, baseplate portion, or hub portion can be optionally formed independently and/or formed by different processes (e.g., powder metallurgy, casting, such as conventional sand casting techniques like vertically parted processes (DISA, forging, and the like)). In various aspects, at least a portion of the involute scroll member, more specifically, the involute scroll portion is formed of a metallic powder material (a sintered powder metal material). In certain aspects, at least a portion of the baseplate portion is formed of a metallic powder material. In certain preferred aspects, the involute scroll portion and the baseplate are integrally formed of a sintered metallic powder material. In yet other aspects, an involute scroll portion, baseplate portion, and hub portion can be integrally formed of a single monolithic sintered powder metal material. In other aspects, the baseplate portion and/or hub portion can be optionally formed by conventional processing, such as casting or forging. In certain aspects, the baseplate portion comprises iron. For example, the baseplate portion is optionally cast of a Grade 30 or higher gray iron. In some aspects, the baseplate portion comprises a metal matrix of a cast iron baseplate portion that comprises at least about 90% pearlite.

A level of net shape and dimensional accuracy of the involute scroll portion of the scroll member is an important consideration during formation of the incoming part. Thus, powder metallurgy techniques are well suited in accordance with the present disclosure to achieve such objectives. For economic reasons, in certain aspects, the baseplate portion and/or the hub portion can optionally be made by less expensive techniques, such as conventional sand casting techniques such as vertically parted processes (DISA, etc.). Such components are optionally formed by the methods disclosed in co-assigned U.S. Pat. No. 6,705,848, incorporated herein by reference in its entirety. Thus, the baseplate and/or hub portions may receive significant post-processing machining, while the involute scroll portion can be used in an as-sintered non-machined state.

In certain aspects, the scroll member comprises a metallic powder material formed with a metal powder having an average particle size of greater than or equal to about 5 micrometers. In certain aspects, the scroll member comprises a metallic powder material formed with a metal powder having an average particle size of greater than or equal to about 5 micrometers to less than or equal to about 100 micrometers. In certain aspects, some or all of the metallic particles of the metallic powder material have an irregular or spherical morphology. The metallic powder material may be a matrix comprising additional constituents, phases, intermetallic components, or particulates, as are well known in the art. In various aspects, at least the involute scroll portion of the scroll member is formed of a metallic powder material that comprises iron. In certain aspects, the involute scroll portion of the scroll member is formed of a metallic powder material that comprises an iron alloy.

Optionally, the metallic powder material for the scroll member can comprise iron alloys with a carbon content at about 0.4 wt. % to about 0.6 wt. %; a copper content at about 1.5 wt. % to about 3.9 wt. %; where the total other elements are about 2.0 wt. % maximum, with the balance being iron. In one variation, the scroll member, including an involute scroll portion and/or a baseplate portion can be formed of a carbon steel material (Metal Powder Industries Federation "MPIF" FC-0208), which is an iron, copper, and carbon alloy having nominally 2% by weight copper and 0.8% by weight carbon, while MPIF FC-0205 is likewise an iron, copper, and carbon alloy having nominally 2% by weight copper and 0.5% by weight carbon. In certain aspects, a hub portion and a combined scroll involute/baseplate portion comprises powder metal materials that comply with the specification for MPIF FC 0205 (copper nominal 2% by weight and carbon nominal 0.5% by weight) and MPIF FC 0208 (copper nominal 2% by weight and carbon nominal 0.8% by weight), respectively. A lower carbon powder metal (MPIF FC-0205) is particularly suitable for use in forming the powder metal hub portion. Either the involute scroll portion/baseplate portion and/or the hub portion are partially sintered to form one or more crystal structures, such as a pearlite phase, in the sintering process.

By way of example, in some aspects, excluding porosity, the metallic powder material that forms the involute scroll member comprises at least about 90% pearlite ($\alpha$-Fe and $Fe_3C$ phases). In certain aspects, the metallic powder materials optionally comprise graphite. For example, certain materials optionally comprise flake graphite. One example of a suitable type of graphite is flake graphite having a maximum length of about 0.64 mm. Inoculation can be used to assure uniformly distributed and adequately sized graphite. It is envisioned that rare earth elements may be added to the powder metal mixture to function as inoculants in certain variations, as well. Either the baseplate portion or the terminal end regions/tips of the involute scroll portion are optionally modified to enhance the tribological properties of the interface. In certain embodiments, local placement of a tribological phase or material on the baseplate portion, for example, on a contact surface of the baseplate portion can be conducted.

In certain aspects, a base iron powder type is mixed with graphite and copper to form the base iron powder that represents a raw material for the scroll member components. A pressing lubricant is then optionally added to the powder. In this variation, the hub and scroll member (involute and baseplate portions) materials comply with the specification for Metal Powder Industries Federation (MPIF) FC 0205 (copper nominal 2% by weight and carbon nominal 0.5% by weight) and MPIF FC 0208 (copper nominal 2% by weight and carbon nominal 0.8% by weight), respectively.

Thus, in various aspects, the powder metal material for forming scroll member components includes at least one powder metal component and optionally includes other materials such as alloying elements and lubricants. In a green state, powder metal components are conventionally held together using lubricated metal deformation from pressing for P/M processing. Conventional lubricant systems for P/M formation are well known in the art and include calcium stearate, ethylene bisstrearamide, lithium stearate, stearic acid, zinc stearate, and combinations thereof.

In various aspects, placing a reinforcement material in addition to an optional tribological material at the terminal end regions of the involute scroll portion preserves fatigue strength. The presence of free graphite or other macro-phase can reduce fatigue strength, so while the presence of graphite and the like as tribological materials is fully envisioned by the present teachings, in certain embodiments, graphite (or another tribological material phase) is distributed at lower concentrations near the root radius (near the baseplate portion of the involute scroll portion) to avoid potential reduced vane strength in the involute scroll portion.

In aspects where the baseplate portion is formed from metallic powder material, it is envisioned, that an alternate approach to introduce a tribological interface between the terminal end regions and the baseplate portion is to employ two or more different powder compositions (e.g., distinct powder metal compositions) introduced during die-filling. In certain aspects, the tips of the vanes of the involute scroll portion would be locally filled with a metallic powder including a tribological material phase. Conversely, the baseplate regions of the scroll member can be similarly filled. As shown in FIG. 5E, a height of the tribologically enhanced region can vary depending upon the specific scroll application. It is contemplated that a minimum height required for maintaining tribological compatibility, good sealing and adequate fatigue strength in the terminal end region of the involute scroll portion as well known by those of skill in the art will be employed. In certain aspects, a height of the tribologically enhanced region in a terminal end region of the involute scroll portion optionally ranges from greater than or equal to about 1 mm to less than or equal to about 5 mm (as measured from a terminal surface or a tip sealing/contact surface of the modified terminal end region in a direction towards the baseplate). To minimize both part cost and dimensional variation of the scroll member during pressing and sintering, in certain aspects, the height of the tribological layer is minimized while providing desired advantages of tip modification.

The composition of the tribological material phase material chosen in the modified terminal end regions of the involute scroll portions depends upon the wear compatibility requirements of the two counter-materials. When both scroll members (orbiting and stationary) comprise plain carbon powder metal steel (rather than cast iron), free graphite or more preferably a free graphite/iron powder alloy is optionally selected, as discussed above. In certain aspects, a composition of the graphite-iron mixture is greater than or equal to about 5 to less than or equal to about 20% volume percent free graphite, optionally greater than or equal to about 10 to less than or equal to about 12% by volume of free graphite, and the remainder carbon steel powder metal (e.g., MPIF FC-0208 alloy discussed above). In certain aspects, graphite particles may be coated with nickel, copper or another similar metal to inhibit its reaction during sintering. If the graphite reacts excessively during sintering, massive (pro-eutectoid) iron carbides can potentially form, which undesirably reduce the amount of free graphite available for lubrication.

Alternatively, other materials can be used for the tribological material phase of a modified tip region that defines a tip component. Certain particulate materials from any of the following general groups may be used: metallic, non-metallic, natural carbon based (organic), synthetic carbon based, intermetallic or ceramic particulates in the form of metal, polymer or ceramic matrix composites or in their pure form, equivalents or combinations thereof. One suitable material is a graphite-iron alloy, which is similar to cast iron (an acceptable scroll material). It is envisioned that the following exemplary, but non-limiting materials serve to enhance tribological properties in sliding wear applications: hexagonal boron nitride, molybdenum disulfide, tungsten disulfide, soft pure metals (such as silver, tin and bismuth), aluminum oxide, silicon carbide, carbon fiber, silica, graphite fluoride, iron sulfide, diamond, and combinations thereof. These materials, by themselves, or in combination with the plain powder metal alloy, like steel, or in combination with the iron-free graphite phase may be used. Macro or nano-sized particles as tribological materials are envisioned. It is contemplated that in certain aspects, 100% of any of these materials is used for a local interface surface. In other aspects, such materials are used as a minor constituent that "enhances" the wear resistance of the base material (for example, plain carbon powder metal steel or the same with free-graphite added). Thus, in certain aspects, the relative amounts of these minor tribological material phase constituents are in the range of greater than or equal to about 0 to less than or equal to about 50% by weight, optionally greater than or equal to about 2 to less than or equal to about 20% by weight.

In this regard, metallic powder materials used in accordance with the present teachings can include a base material and at least one tribological constituent are referred to herein as "dual phase" components; however, the materials are not limited solely to two phases. The specific powdered metal methodology used to produce the "dual powder component" is not limited to any particular method. However, one such powder metallurgy method is to use two powder feeding events with two separate feeding "shoes." Each fill shoe sequentially positions itself over the powder metal die (in the shape of the portions of the scroll member to be formed) and fills the respective regions (special tribological material phase composition powder for the vane tips of the involute scroll portion and the conventional base material powder for the remainder of the scroll part). In other aspects, a baseplate portion may be similarly formed by being filled with a tribological material.

An integral tribological modification approach, such as to form a gradient of composition between the tribological material phase and the parent base material in the involute scroll portion and/or baseplate portion is contemplated. Thus, in certain embodiments, in filling the desired portions of the mold, a first material having a tribological material phase may be first be introduced and then a mixture of the first material and a second material (or one or more mixtures of the first material and a second material with differing concentrations) can be added, followed by the second material alone to create such a gradient. In alternative embodiments, the first material and second material may be introduced separately without such mixing, but allowed to settle, migrate, or otherwise mix prior to sintering to form the concentration gradient of the tribological material and the base material. Such a gradient creates a stronger more robust bond in the body of the involute scroll, which is believed to last longer than a comparative coating or plating which typically exhibits abrupt interfaces.

As noted above, in certain variations, the powder metal material is processed to form a green component. In some aspects, this processing generally includes introducing the powder metal material into a die, where the powder material may be compressed. In certain aspects, the scroll member is processed to a green form by compressing the powder metal material to a void fraction of less than or equal to about 25% by volume of the total volume of the scroll component (in other words, a remaining void space of about 25% of the total volume of the shape), optionally less than or equal to about 20%, and in certain aspects, optionally less than or equal to about 18% of the void volume of the scroll component. Thus, in various aspects the powder metal material (generally including a lubricant system) is placed in a mold of a desired shape and is then compressed with all materials intact. The compression forms a green form, which holds a form and shape corresponding to the die shape.

In accordance with certain principles of the present disclosure, the green structure that is formed, including a metal component and an alloying element is processed via a first sintering process. The first heating process for sintering includes at least partial sintering of the green structure and in certain variations, full sintering of the green structure to form a final sintered structure. "Partial sintering" means that the green scroll component formed from powder metal material is processed via the first sintering process, where it is exposed to a heat source; however, the duration of the exposure is less than is required to achieve substantially complete metallurgical bonding and fusing between the metal particles. In certain aspects, the partial sintering of the green component may be conducted at lower temperatures or for shorter durations than a second final heating process for sintering and brazing.

As seen in FIGS. 5B, 5D, and 5F, a pre-formed tip component can be placed against the as-pressed scroll prior to sintering in certain variations. Alternatively, such pre-formed tip components can be coupled with the coupling surface of the terminal end of the involute scroll portion subsequent to the sintering process. The placement of the pre-formed tip component can optionally be on a terminal end of the vane of the involute scroll portion. The shape of the pre-formed tip component can be spiral-shaped to match the involute scroll portion shape (and any coupling features disposed thereon). During sintering, the pre-formed tip component, such as a tip cap, can then partially diffuse into the underlying material (the metallic powder forming the involute scroll portion) or sinter-bond itself to the involute scroll portion. The pre-formed tip component is optionally composed of materials previously discussed that have desirable tribological materials, such as graphite-iron alloy or another material (ceramic, etc.). The strength of the pre-formed tip component (e.g., tip cap) can be sufficient to allow handling and positioning without breaking or cracking. The pre-formed tip component (e.g., tip cap) may be, but is not limited to, a wrought metal, extruded metal, injection molded polymeric matrix, or even another powder metal component. The placement of the pre-formed tip component (e.g., tip cap) on a green part can be achieved by automated/robot technologies. In certain variations, the composition of the tip component (e.g., tip cap) remains stable and does not decompose, completely melt or vaporize at steel sintering temperatures (e.g., approximately 2,050° F.). The tip component (e.g., tip cap) ideally adheres with the surface of the adjacent involute scroll portion or baseplate portion during sintering to create a strong bond.

As regards FIG. 5E, the second tribological material phase in the form of a metallic powder can be incorporated into the tips at the terminal end region to define a tip cap. Regarding FIG. 5E, this embodiment differs from the sinter-bonded tip cap components shown in FIGS. 5D and 5F in that a tribological material (see, e.g., 90) present in the composition at the terminal end regions of the involute scroll portion has a lower melting point than the underlying ferrous material forming the involute scroll portion. In one embodiment, the tribological material phase 90 has a physical shape similar to the sinter-bonded pre-formed component (e.g., 80 of FIG. 5D, 84 of FIG. 5F) discussed above. It is placed on the as-pressed part (e.g., a green powder metal part) prior to sintering. During sintering, the tribological material phase 90 melts and penetrates into the voids of the sintered metallic particles of the primary material of the powder metal involute scroll portion of the scroll member. In certain aspects, such a tribological material phase 90 has a solidus or liquidus temperature lower than the sintering temperature of the primary material, such an iron-containing powder material (for example, 2,050° F.). During sintering, some or all of the tribological material phase 90 melts and penetrates the pores of the sintered metal.

Similar to the pre-form component embodiments discussed above, a composition of the tribological material phase 90 defining the tip component (e.g., tip cap) can be such that it protects the two mating surfaces from unacceptable abrasive or adhesive wear. Conventional non-ferrous "bearing"-type alloy materials well known to those of skill in the art can be used. Non-limiting examples include copper based alloys such as tin-bronze, aluminum-bronze, graphitic bronze, tin/antimony/copper (tin babbitt) alloys, tin-aluminum bearing alloys, pure tin and pure copper are acceptable. Although the previous discussion centers on tribological enhancement before sintering of the metallic powder scrolls, it is envisioned in certain variations that these operations are performed after sintering. In this regard, a process is contemplated that can use separate process steps such as microwave, induction or conventional heating either locally (for example, to terminal end regions of involute scroll portion or a contact surface of a baseplate portion) or applied to the entire scroll member to form the tip cap comprising the tribological material phase.

In certain aspects, it is envisioned the tribological material phase (e.g., alloy), does not completely penetrate the pores of the sintered powder metal. The tribological alloy upon melting can be selected such that it reacts with the parent metal in a manner that minimizes penetration more than about 4 mm or 5 mm from the powder metal scroll member's surface. One such tribological material alloy having these desired characteristics is the brazing material disclosed in U.S. Pat. No. 6,705,848, which is herein incorporated by reference in its entirety.

Another variation involves an "infiltration" technique used to impregnate the scroll with a tribological material phase after sintering. With this, a sealant material is chosen to perform, not only its traditional functions, which are gas sealing and machinability enhancement, but also functions to improve the wear properties at one or more contact surfaces. Such an infiltration may be local (only at surfaces corresponding to contact regions, such as the terminal end regions/vane tips of the involute scroll portion of the scroll member or contact surfaces of baseplate portions) or global (extending to all the surfaces of the entire scroll member) depending upon economic considerations. Suitable non-limiting sealant materials for such an infiltration technique are: graphite (with or without a carrier or binder fluid to help transport it into the porosity of the metallic powdered material), PTFE (with or without a similar carrier or binder) or PTFE filled with soft metal particulates (such as lead, tin, copper alloys, aluminum alloys, or any of the other forms of solid lubricant mentioned herein, and the like). Methods such as vacuum impregnation or vacuum plus pressurization can be used to augment the infiltration into the sintered powder metal material forming the scroll component.

FIG. 6 represents a perspective view of the formation of an alternate scroll component according to certain aspects of the present disclosure. Shown is a scroll member 100 in its green state. As shown, a green scroll member 100 is the orbiting scroll that has been molded to have a baseplate portion 112, an involute scroll portion 114, and a hub portion 116. A tip component in the form of a tip cap 120 can then be coupled to a coupling surface 122 along a terminal end region 124 of the involute scroll portion (spiral vane), with any of the techniques described above.

For either conventional powdered metal or metal injection molding (MIM), the powder metal components can be held together using a binder system in the green state (prior to full sintering). There are several binder systems envisioned for use in the scroll formation process: wax-polymer, acetyl based, water soluble, agar water based and water soluble/cross-linked binders. "Acetyl" based binder systems have as main components polyoxymethylene or polyacetyl with small amounts of polyolefin. The acetyl binder systems are crystalline in nature. Because of the crystallinity, the molding viscosity can be relatively high and this may require close control of the molding temperature. This binder is debound by a catalytic chemical de-polymerization of the polyacetyl component by nitric acid at low temperatures. This binder and debinding process for removing the binder before sintering is faster, particularly for thicker parts. Molding temperatures can be about 180° C. and mold temperatures are about 100-140° C., which is relatively high.

It is further envisioned that a "wax-polymer" binding system may be used. This binding system has good moldability, but since the wax softens during debinding when the binding system is removed prior to sintering, distortion may be a concern. Fixturing or optimized debinding cycles are needed and can overcome this potential issue. It is envisioned that a multi-component binder composition may be used so that properties change with temperature gradually. This allows a wider processing window. Wax-polymer systems can be debound in atmosphere or vacuum furnaces and by solvent methods. Typical material molding temperatures are about 175° C. and mold temperatures are typically 40° C.

It is further envisioned that a "water soluble" binder may be used. "Water soluble" binders can be composed of polyethylene with some polypropylene, partially hydrolyzed cold water soluble polyvinyl alcohol, water and plasticizers, for example. Part of the binder can be removed by water at about 80-100° C. Molding temperatures are about 185° C. This system is environmentally safe, non-hazardous and biodegradable. Because of the low debinding temperatures, the potential propensity for distortion during debinding is lower.

It is further envisioned that "agar-water" based binders can be used. Agar-water based binders have an advantage because evaporation of water is the phenomenon that causes debinding, and thus, no separate debinding processing step is needed. Debinding can be incorporated into the sinter phase of the process. Molding temperature generally is about 85° C. and the mold temperature is cooler. During molding, water loss may occur that may affect both metal loading and viscosity. Therefore, careful controls may need to be incorporated to control and minimize evaporation during processing. Another potential disadvantage is that the molded parts are soft and require special handling precautions. Special drying procedures immediately following molding may be incorporated to assist in handling.

It is further envisioned that a "water soluble/cross-linked" binder can be used. Water soluble/cross-linked binders involve initial soaking in water to partially debind, and then a cross-linking step is applied. This is sometimes referred to as a reaction compounded feedstock. The main components comprise methoxypolyethylene glycol and polyoxymethylene polymers. This binder/debinding system tends to provide low distortion and low dimensional tolerances. In addition, high metal loading can be achieved when different powder types are blended.

Optionally, fixturing during debinding and/or sintering can be used to help prevent part slumping. This may be particularly useful when a tip component is coupled to the involute scroll portion prior to a full sintering process. It has been found that "under-sintering" (but still densifying to the point where density/strength criteria are met) helps to maintain dimensional control. Fixturing may be accomplished by using graphite or ceramic scroll member shapes to minimize distortion.

The design geometry of the scroll can be optimized if metal injection molding processing is used to form the scroll member. The wall thickness is advantageously as uniform and thin as possible throughout the part, and coring can be used where appropriate to accomplish this. Uniform and minimal wall thickness minimizes distortion, quickens debinding and sintering, and reduces material costs.

It has been found that the metal injection molding process disclosed generally produces a relatively dense part (optionally greater than or equal to about 7, optionally greater than or equal to about 7.1, optionally greater than or equal to about 7.2, optionally greater than or equal to about 7.3, and in certain aspects, in excess of 7.4 specific gravity). This is a unique aspect of metal injection molding process, which produces very high strength material, while permitting thinner and lighter scrolls than cast iron designs.

In certain aspects, the final sintered density of the scroll part (fixed and orbital) is greater than or equal to about 6.5 g/cm$^3$, optionally about greater than or equal to about 6.8 g/cm$^3$, optionally greater than or equal to about 6.9 g/cm$^3$, greater than or equal to about 7 g/cm$^3$, optionally greater than or equal to about 7.1 g/cm$^3$, optionally greater than or equal to about 7.2 g/cm$^3$, optionally greater than or equal to about 7.3 g/cm$^3$, and in certain aspects, in excess of 7.4 g/cm$^3$. In certain aspects, density is as uniformly distributed as possible throughout the portions of the scroll member formed from the sintered powder metal material. For some applications, a minimum density is maintained to comply with the fatigue strength requirements of the scroll. Potential leakage through the interconnected metal porosity is also a potential concern because of loss in compressor efficiency. The incorporation of higher density materials with no other treatments may be sufficient to produce desired pressure tightness. Also, impregnation, steam treatment or infiltration (polymeric, metal oxides, or metallic) may optionally be incorporated into the pores to seal off interconnected pores, if necessary.

In certain aspects, the material composition of a final scroll member portion formed from a sintered primary parent powder metal material (exclusive of tribological material phases) is greater than or equal to about 0.6 to less than or equal to about 0.9% carbon (having about 3.0 to about 3.3% free graphite, when present), 0 to less than or equal to about 10% copper, 0 to less than or equal to about 5% nickel, 0 to less than or equal to about 5% molybdenum, 0 to less than or equal to about 2% chromium and the remainder iron and typical impurities present in iron alloys. Minor constituents may be added to modify or improve some aspect of the microstructure, such as hardenability or pearlite fineness.

In some aspects, the final material matrix microstructure is similar to that of cast iron. Although, a graphite-containing structure may be selected depending upon the tribological requirements of the compressor application, a suitable microstructure for the component formed from metallic powder contains no free graphite. The presence of free graphite potentially decreases compressibility of the powder and may adversely affect dimensional accuracy and tolerances. As discussed above, one scroll (e.g., the fixed scroll) optionally contains graphite, as where the other scroll (e.g., the orbital scroll) does not. In certain aspects, the sintering cycle is optionally performed such that the final part contains a matrix structure that at least 90% pearlite minimum by volume (discounting voids). If free graphite is present, it is optionally in a spherical, irregularly shaped, or flake form. The volume percent free graphite is greater than or equal to about 5% and less than or equal to about 20%; optionally greater than or equal to about 10% and less than or equal to about 12% graphite. In some aspects, graphite particle size (average diameter) is about 40 to about 150 micrometers (microns) in effective diameter.

As mentioned above, the tribological particles, like free graphite, may be concentrated at specific sites on the scroll that require special tribological properties (see U.S. Pat. No. 6,079,962, hereby incorporated by reference). In other aspects, the tribological materials are evenly dispersed throughout the scroll member. Particle size, shape and dispersion are selected to maintain acceptable fatigue resistance and tribological properties (low adhesive and abrasive wear). The metallic powder materials are generally capable of being run against itself without galling during compressor operation. In certain aspects, the presence of graphite within at least one of the mating scrolls allows for this wear couple to successfully exist for long operational periods. The dimensional change effects from the addition of graphite, where incorporated, are accounted for in the design of the metal injection molding or powder metal tooling, as appreciated by those of skill in the art.

In various aspects, when forming a scroll member comprising a sintered powder metal material it is important to maintain dimensional accuracy and avoid distortion during molding, sintering, and tooling (dies and punches). It is envisioned that one or a combination of the following powder metal enabling technologies may be employed to control involute tool distortion. One option is to machine the green compacted scroll member prior to sintering. As discussed above, in certain embodiments, such machining may form a coupling feature in accordance with certain aspects of the present disclosure.

By way of example, the green solid scroll member, such as the exemplary scroll member 100 shown in FIG. 6, can be made from a process and material that allows sufficient green strength to support the machining stresses (such as warm compaction) and the associated clamping stresses required to machine it. In one variation, metallic powders are coated with a binder that can withstand the higher compacting temperatures up to about 300° F. In certain aspects, a minimum tensile strength of the green part is about 3,000 psi.

In "warm compaction," a specially bonded powder material is used for superior flow characteristics when heated. The powder and die are heated up to about 300° F. (prior to and during molding). Warm compaction makes a stronger green powdered metal part with a higher and more uniform density condition within the green part, as well as the final sintered part. The higher density uniformity reduces the chance of sinter distortion. Moreover, the warmly compacted green compact is stronger than traditionally molded parts and will, therefore, not crack as easily during handling. Warm compacting the involute scroll member 100 will also allow the molded part to be removed from the die more easily, thereby reducing ejection rejects. Another unique advantage of warm compaction is that it allows the machining of the green (as pressed) part, sometimes called green machining. As mentioned above, combining green machining with warm compaction provides advantages, including easier machining of green parts, because the parts are not yet sintered to full strength, as well as formation of stronger green parts for easier handling and chucking.

Another processing aid for scroll member powder metal production is "die wall lubrication." In this technique, a wall of a die mold to be filled with powder metal material(s) is coated with a special lubricant, which is either a solid spray or liquid form, and is stable at high temperatures. This lubricant reduces powder-to-die wall friction, which can improve density and flow characteristics of the powder(s). Moreover, die wall lubrication can be used as a replacement (or partial replacement) to lubrication within the powder (internal lubrication). Internal lubrication may use about 0.75% lubrication, whereas die wall lubrication results in about 0.05% internal lubrication. Relatively low amounts of internal lubrication results in higher densities, better density distribution, less sooting in the furnaces, greater green strength, less green state spring back after compaction, better surface finishes, and less ejection forces required. The die wall lubricant may be a liquid or a solid, which are well known in the art.

In certain aspects, a die wall may be heated to a temperature of about 300° F. to melt and/or liquefy the lubricant. Liquefied lubricant produces less metal friction. As a variant to such an embodiment, the die wall lubricant may be of a variety that has a low melting point (as low as 100° F.). With these properties, the die wall lubricant can be easily transformed to a liquid during the compaction process. Mixing high and low temperature lubricants may bring the effective melting point of the blend down to below the value of the highest melting point constituent as long as the temperature used is higher than a certain threshold value. In certain aspects, the lubricant powder is well-mixed prior to spraying into the die cavity. Fluidization is an acceptable way to accomplish this. Blending of different melt temperature lubricants also assists the fluidization effect. With blends, care must be taken to prevent physical separation of the blended lubricants during fluidization. One such combination of lubricants comprises ethylene bis-stearamide (EBS), stearic acid, and lauric acid.

Another optional technique to facilitate scroll member powder metal manufacturing is to size or "coin" after sintering. This process entails repressing the sintered part in a set of dies that refines the dimensional accuracy and reduces dimensional tolerances relative to the as-sintered part. This brings the part even closer to a desired net shape and somewhat strengthens it.

A concept that avoids the complications of high stresses on the dies and punches is to use "liquid metal assisted sintering." The pressed green form is made of the same composition as described above, only with lower pressure applied than normal, thus producing less density and a higher level of porosity. The lower pressing pressures apply less stress on the dies thereby increasing die life and ejection problems. Then, during sintering, about 10% by weight copper alloy is melted throughout the part. The molten copper alloy increases the rate of sintering. In the final sintered part, the copper alloy increases the strength of the part to a sufficient level. As a side benefit, the copper dispersed within the resulting part may aid the tribological properties during compressor operation. Liquid metal assisted sintering, however, increases the amount of distortion in the scroll after sintering.

As discussed above, fixturing during sintering or brazing may be desirable to minimize dimensional distortion. Fixturing may be accomplished by using graphite or ceramic scroll member shapes that help to maintain the involute scroll portion scroll shape. Other fixture configurations, such as spheres can be placed in between the scroll wraps to support them. Also, since the part shape and size changes during sintering, frictional forces between the part and the holding tray are important. It may be necessary to increase or decrease friction depending upon the reason. Decreasing friction is the most common way to reduce distortion and may be accomplished by applying alumina powder between the parts and tray, for example.

Consistency and uniformity of metallic powder and part composition can also minimize dimensional tolerances. Segregation during feeding of powder particles can occur. Powder feeding and transfer mechanisms that avoid powder segregation are important for processing. One way to avoid powder segregation is to use pre-alloyed or diffusion bonded metallic powder particles. In these cases, each particle of powder has the same composition, so segregation is less of an issue. Another simple way to avoid this is to fill the dies rapidly after mixing the powder. Choice of binder and resultant powder flow affects dimensional stability (sinter distortion) by reducing the density variation along the part.

Powder flow should be high enough to produce uniform density from thick to thin sections, but not too high to encourage particle size segregation. High temperature binders are believed to better prevent flow problems.

Adequate process controls on various steps in the manufacture of powder metal scroll components can also affect dimensional accuracy and tooling distress. Two examples of such steps include monitoring green part properties (density and dimensions) and sintering temperature oven uniformity within a load.

The die walls themselves can optionally contain a coating, such as a permanent coating with lubricant to minimize friction. Coatings such as diamond or chromium have been used. Die coatings allow less lubricant to be needed in the powder, which reduces blisters and increases green strength and compressibility as stated above in the die wall lubrication section.

In some aspects, during processing, it is important to ensure complete die filling with powder material. To allow the powder to completely fill the die, techniques such as vibration, fluidization, or vacuum may be used to help transport the powder into the scroll member cavity. Segregation of powder should be avoided during vibration, where possible, as previously mentioned. Bottom feeding or bottom and top feeding of the powder may also be necessary to achieve this end.

The disclosure provides a method for forming a scroll component. In certain aspects, such a method includes introducing a mixture comprising metallic powder into a mold cavity (or die) defining an involute scroll member cavity. In certain embodiments, one or more compositions comprising tribological material(s) can be introduced into certain regions of the mold (e.g., into involute scroll portions of the scroll member), while other regions of the mold comprise a powder metal material without such tribological materials. The mixture is compressed in the mold to form a green involute scroll member. Then, the green involute scroll member is removed from the mold.

In certain variations, a tip component comprising a tip seal or a tip cap is positioned on a terminal end region of a green involute scroll portion of a scroll member to be coupled therewith. As discussed above, this positioning may optionally include the use of a coupling feature, such as a groove or flange on a terminal end region of an involute scroll portion vane. Such a coupling feature may be molded into the terminal end region or alternately, the positioning of a tip seal or tip cap component may be preceded by a green-machining step to form a coupling feature. Next, in certain variations, the involute scroll member having a tip component, for example, a tip seal or a tip cap, is sintered to form an involute scroll member of the scroll component. A bond formed between the involute scroll portion and the tip seal or tip cap components during the sintering process is strong and capable of withstanding long-term scroll compressor operations, including high operating pressures while withstanding frictional stresses.

In some aspects, the method also includes preparing the mixture comprising metallic powder by mixing a metallic powder with a binder, and then introducing the pre-mixed mixture into the mold. As discussed above, the component (e.g., tip seal or tip cap) optionally includes a tribological material selected from the group consisting of hexagonal boron nitride, molybdenum disulfide, graphite fluoride, iron sulfide tungsten disulfide, aluminum oxide, silicon carbide, carbon fibers, silica, diamond, graphite, tin, silver, bismuth and combinations thereof. In other aspects, the metallic powder comprises iron and has a mean diameter of greater than or equal to about 5 micrometers and in certain aspects, less than or equal to about 100 micrometers. In yet other aspects, the methods include machining the green involute scroll member after it is removed from the mold, but before sintering.

In certain aspects, a modified tip component comprising a tip cap can be formed on an involute scroll portion of a scroll member after sintering by introducing a tribological material onto the surface and into a tip region (terminal end region) of the involute scroll portion of the scroll member. Such introducing may be injecting the tribological material into the sintered porous metal tip region. In other aspects, the introducing of a tribological material may occur on a contact region of a baseplate portion or other surface of the scroll member that experiences wear, for example, by injecting the material after the sintering process.

In summary, the present disclosure provides improved scroll members for a scroll compressor and methods for making such improved scroll members. In certain aspects, the present disclosure provides a scroll member that comprises an involute scroll portion and a baseplate portion. The scroll member optionally comprises a sintered powder metal material. The involute scroll portion defines a modified terminal end region comprising an as-sintered coupling feature and further comprises a tip component comprising a tip seal component or a tip cap component (or both a tip cap component and a tip seal component) that forms a contact surface for contacting an opposing scroll member during compressor operation.

In certain variations, the as-sintered coupling feature is selected from the group consisting of: a groove, a ridge, a protrusion, a flange, a flat wear surface or combinations thereof. For example, the coupling feature can be a groove defining at least one tapered wall to receive a tip seal in certain embodiments. In other embodiments, the tip component comprises a tip cap sinter-bonded to the coupling feature. In yet other embodiments, the terminal end region may comprise both a tip cap component and a tip seal coupled to the as-sintered coupling feature. For example, where a tip cap component is in the form of a flange that further defines a groove, the tip cap component can be coupled to the as-sintered coupling feature, while the groove of the flange can receive a tip seal disposed therein.

In other aspects, the tip component comprises a tribological material. In certain aspects, the tip component is a tip cap defining a flat wear surface. Such a tribological material is optionally selected from the group consisting of metallic particles, non-metallic particles, natural carbon based particles, synthetic carbon based particles, intermetallic particles, nano-ceramic particulates, macro-ceramic particles and mixtures thereof. The tribological material is selected from the group consisting of hexagonal boron nitride, molybdenum disulfide, tungsten disulfide, graphite fluoride, iron sulfide, aluminum oxide, silicon carbide, carbon fibers, silica, diamond, graphite, tin, silver, bismuth, and combinations thereof.

Further, in certain variations, the sintered powder metal material comprises a first alloy comprising copper at greater than or equal to about 1.5 weight % to less than or equal to about 3.9 weight %, carbon at greater than or equal to about 0.6 weight % to less than or equal to about 0.9% by weight, and a balance iron; or a second alloy comprising copper at greater than or equal to about 1.5 weight % to less than or equal to about 3.9 weight %, carbon at greater than or equal to about 0.4 weight % to less than or equal to about 0.6% by weight, and a balance iron. In certain aspects, the sintered powder metal material is optionally formed from a metallic powder comprising a plurality of metallic particles having an irregular morphology or alternatively a spherical morphology. In various aspects, such modified terminal end region of involute scroll portion of these various embodiments has excellent dimensional tolerances, can withstand wear during harsh compressor operating conditions, all while providing superior axial sealing.

In other variations, a scroll member is provided that comprises an involute scroll portion and a baseplate portion. The scroll member comprises a first sintered powder metal material, which may comprise the iron alloys described above. Further, the involute scroll portion defines a modified terminal end region that comprises a second material comprising at least one tribological material. The tribological material of the second material is like any of those described above. The second material having such a tribological material forms a contact surface (e.g., a wear surface) capable of contacting an opposing surface of an opposing scroll member and withstanding wear during compressor operation. In certain aspects, the second material is sintered and both the first sintered powder metal material and the second material independently comprise the iron alloys set forth above.

In certain aspects, the second material is formed from the sintered powder metal having the tribological material added thereto prior to sintering. In other aspects, a concentration gradient is formed by the tribological material from a terminal surface of the modified terminal end region in a direction of the baseplate. The concentration gradient facilitates formation of a robust bond between the first and second materials, especially for embodiments where both the first and second materials are sintered powder metal materials. In yet other variations, the second material has a height measured from a terminal surface of the modified terminal end region in a direction of the baseplate (along the involute scroll portion) of greater than or equal to about 1 mm and less than or equal to about 5 mm, which is certain aspects is preferably less than or equal to about 4 mm. Again, such a modified terminal end region of the involute scroll portion has excellent dimensional tolerances, but can also withstand wear during harsh compressor operating conditions, while providing superior axial sealing with low abrasion and friction losses.

In yet other variations, a method for forming a scroll member comprises introducing a metallic powder metal material comprising an iron alloy into a mold defining a cavity having a shape defining an involute scroll portion of the scroll member. The method further comprises compressing the mixture into the mold to form a green involute scroll member that includes an involute scroll portion that defines a terminal end having a coupling surface feature that is capable of receiving a tip component, such as a tip seal component or a tip cap component. Then, the green involute scroll member is removed from the mold. The involute scroll member is then sintered to form an involute scroll portion comprising the as-sintered coupling feature.

In certain aspects, after removing the green involute scroll member and prior to sintering, a tip component (e.g., tip cap) can be placed into contact with the coupling feature. After the sintering process, an involute scroll member is formed having a sinter-bonded tip component on the terminal end of the involute scroll portion. In other alternative variations, after the sintering, a tip component can be subsequently disposed in the as-sintered coupling feature.

In yet other aspects, the present disclosure provides other methods of making a scroll member that comprises forming the scroll member defining an involute scroll portion and a baseplate portion by sintering a first powder metal material in a mold defining a cavity having a shape defining the involute scroll portion and the baseplate portion. The scroll member comprises a first sintered powder metal material. The involute scroll portion of the scroll member defines a terminal end region that further comprises a second material comprising a tribological material that forms a contact surface for contacting an opposing scroll member during compressor operation.

In certain aspects, the first sintered powder metal material and the second material each independently comprises the iron alloys described above. In yet other aspects, prior to the sintering, the second material is also introduced into a portion of the cavity corresponding to the terminal end region of the involute scroll portion so as to form a second sintered material composition comprising the tribological material. Furthermore, the methods may optionally comprise introducing the tribological material into the terminal end region via infiltration of the first sintered powder metal material to form the second material after the sintering process. Again, the first, second, and tribological materials may comprise any of those described above.

For example, the first powder metal material and the second material may each independently comprise a first alloy or a second alloy. The first alloy comprises copper at greater than or equal to about 1.5 weight % to less than or equal to about 3.9 weight %, carbon at greater than or equal to about 0.6 weight % to less than or equal to about 0.9% by weight, and a balance iron. The second alloy comprises copper at greater than or equal to about 1.5 weight % to less than or equal to about 3.9 weight %, carbon at greater than or equal to about 0.4 weight % to less than or equal to about 0.6% by weight, and a balance iron. In certain aspects, prior to the sintering, the method may further comprise introducing the second material into a portion of the cavity corresponding to the terminal end region of the involute scroll portion so as to form a second sintered material composition comprising the tribological material.

In other aspects, after the sintering, the second material comprising the tribological material may be formed by introducing the tribological material into the terminal end region of the first sintered powder metal material via infiltration. In yet other aspects, the tribological material optionally comprises a material selected from the group consisting of hexagonal boron nitride, molybdenum disulfide, graphite fluoride, iron sulfide tungsten disulfide, aluminum oxide, silicon carbide, carbon fibers, silica, diamond, graphite, tin, silver, bismuth and combinations thereof.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The description of the teachings is merely exemplary in nature and, thus, variations that do not depart from the gist of the disclosure are intended to be within the scope of the disclosure. Such variations are not to be regarded as a departure from the spirit and scope of the invention.

What is claimed is:

1. A scroll member comprising:

an involute scroll portion and a baseplate portion comprising a sintered powder metal material, wherein said involute scroll portion defines a terminal end region defining an as-sintered coupling feature and comprises a tip component in the form of a tip seal that forms a contact surface for contacting an opposing scroll member during compressor operation, wherein the as-sintered coupling feature comprises a protruding ridge or flange having a tip cap that is sinter-bonded to the protruding ridge or flange, wherein the tip cap comprises a groove that receives the tip component.

2. The scroll member of claim 1, wherein said tip component is sinter-bonded to said as-sintered coupling feature.

3. The scroll member of claim 1, wherein said tip component comprises a tribological material.

4. The scroll member of claim 3, wherein said tribological material is selected from the group consisting of: metallic particles, non-metallic particles, natural carbon based particles, synthetic carbon based particles, intermetallic particles, nano-ceramic particulates, macro-ceramic particles and combinations thereof.

5. The scroll member of claim 3, wherein said tribological material is selected from the group consisting of: hexagonal boron nitride, molybdenum disulfide, tungsten disulfide, graphite fluoride, iron sulfide, aluminum oxide, silicon carbide, carbon fibers, silica, diamond, graphite, tin, silver, bismuth, and combinations thereof.

6. The scroll member of claim 1, wherein said sintered powder metal material comprises:

a first alloy comprising copper at greater than or equal to about 1.5 weight % to less than or equal to about 3.9 weight %, carbon at greater than or equal to about 0.6 weight % to less than or equal to about 0.9 weight %, and a balance iron; or a second alloy comprising copper at greater than or equal to about 1.5 weight % to less than or equal to about 3.9 weight %, carbon at greater than or equal to about 0.4 weight % to less than or equal to about 0.6 weight %, and a balance iron.

7. The scroll member of claim 1, wherein said sintered powder metal material is formed from a metallic powder comprising a plurality of metallic particles having an irregular morphology.

8. The scroll member of claim 1, wherein the tip cap is formed of a distinct material from the sintered powder metal material forming the involute scroll portion.

9. A method for forming a scroll member comprising: introducing a powder metal material comprising an iron alloy into a mold defining a cavity having a shape defining an involute scroll portion of said scroll member; compressing said powder metal material into said mold to form a green involute scroll member that comprises an involute scroll portion that defines a terminal end comprising a coupling feature that is capable of receiving a tip component in the form of a tip seal; and sintering said green involute scroll member to form a sintered involute scroll portion comprising an as-sintered coupling feature, wherein the as-sintered coupling feature comprises a protruding ridge or flange having a tip cap that is sinter-bonded to the protruding ridge or flange, wherein the tip cap comprises a groove that receives the tip component.

10. The method of claim 9, wherein after said compressing of said green involute scroll member and prior to said sintering, disposing the tip cap in contact with said as-sintered coupling feature in the form of the protruding ridge or flange, wherein after said sintering said sintered involute scroll portion has a sinter-bonded tip cap component on said terminal end.

* * * * *